United States Patent [19]

Viellefont et al.

[11] 4,417,953

[45] Nov. 29, 1983

[54] PROCESS AND APPARATUS FOR SEPARATING AN ELECTROLYTIC DEPOSIT FROM BOTH SIDES OF A CATHODE

[75] Inventors: Jean F. Viellefont, Herenthout; Henri M. F. J. Forton, Neerpelt, both of Belgium

[73] Assignee: Metallurgie Hoboken-Overpelt, Hoboken, Belgium

[21] Appl. No.: 287,069

[22] Filed: Jul. 27, 1981

[30] Foreign Application Priority Data

Aug. 6, 1980 [LU] Luxembourg ..... 82691

[51] Int. Cl.[3] ..... C25D 1/04; C25D 17/00

[52] U.S. Cl. ..... 204/12; 204/194; 204/226

[58] Field of Search ..... 156/584; 204/281, 226, 204/194, 198, 12

[56] References Cited

U.S. PATENT DOCUMENTS

| | | | |
|---|---|---|---|
| 3,124,521 | 3/1964 | Sviadoshch | 204/194 |
| 3,625,806 | 12/1971 | Wennberg | 204/226 |
| 3,636,677 | 1/1972 | McNamara | 204/12 |
| 3,883,403 | 5/1975 | Ettel | 204/12 |
| 4,045,301 | 8/1977 | Wens | 204/12 |

FOREIGN PATENT DOCUMENTS

| | | | |
|---|---|---|---|
| 45-242 | 1/1970 | Japan | 204/12 |
| 1240012 | 7/1971 | United Kingdom | 204/12 |
| 1387790 | 3/1975 | United Kingdom | 204/12 |

*Primary Examiner*—T. M. Tufariello

*Attorney, Agent, or Firm*—Pennie & Edmonds

[57] ABSTRACT

An apparatus for separating electrolytic deposits from both sides of a generally vertically suspended cathode includes sets of suction cups which are attached to the deposits on both sides of the cathode. The sets of suction cups are configured and arranged so as to be capable of moving from a first position wherein the sets of suction cups are attached to the deposits to a second position wherein the sets of suction cups are positioned away from the cathode. Arms which are pivotally mounted about a first horizontal axis are connected to the lower edge of a respective set of suction cups by a first jointed coupling which is also connected to the arms. A second jointed coupling is connected to the set of suction cups so as to permit the set of suction cups to pivot about the first jointed coupling. Mechanisms are provided for pivoting the arms about the first horizontal axis and additional mechanisms being pivotally mounted about a second horizontal axis located at a lower level than the first horizontal axis. Both mechanisms are selectably operable so as to detach the deposits from the sides of the cathode and thereafter position the deposits in a rest position with the sets of suction cups above the deposits such that the electrolytic sides can be inspected. In one preferred embodiment, knives are provided on both sides of the cathode so as to separate the deposits which might be integrally connected at the lower edge of the cathode. A system incorporating the aforementioned apparatus also includes a thermal pretreatment station and a mechanical pretreatment station both of which provide for the creation and widening, respectively, of zones of separation of the deposit from the cathode adjacent the upper edge of the deposit. A method for separating electrolytic deposits from a cathode is also disclosed.

19 Claims, 13 Drawing Figures

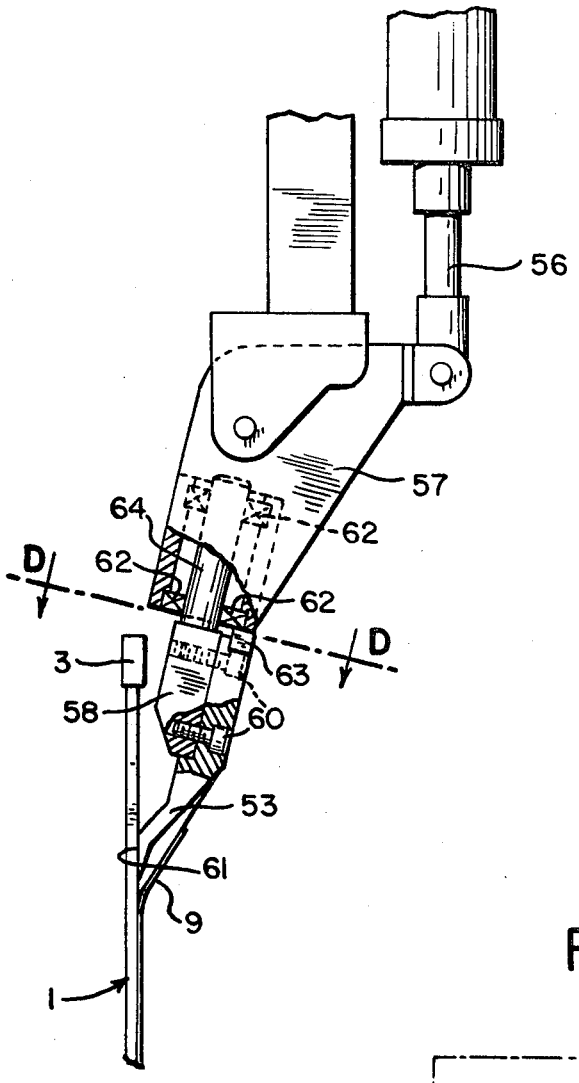
FIG. 9
FIG. 10
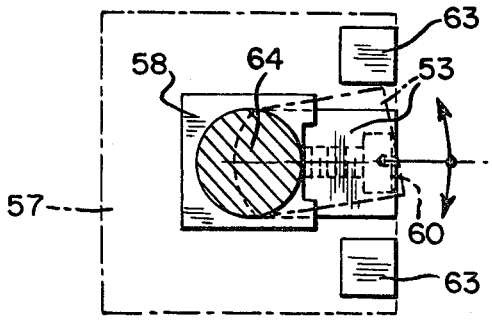

PROCESS AND APPARATUS FOR SEPARATING AN ELECTROLYTIC DEPOSIT FROM BOTH SIDES OF A CATHODE

DESCRIPTION

1. Technical Field

This invention relates to a process for separating an electrolytic deposit from a cathode. More particularly, the present invention related to a process for separating the deposits from both sides of a vertically suspended cathode whereby the upper edge of the deposits is at least locally detached from the cathode. A set of suction-cups is then attached to each of both deposits and both sets of suction-cups are then pivoted to a rest position. In this position, the deposits are detached from the sets of suction-cups.

2. Background Art

The process of removing electrolytic deposits from a cathode is known in the art. Such a process is described in British Pat. Nos. 1,240,012 and 1,387,790. According to these patents the sets of suction-cups can be pivoted on a fixed horizontal axis to a rest position. The horizontal axis is parallel to and located under the cathode. Thus, in the rest position, the deposits are located above the sets of suction-cups with their electrolyte side, i.e., the side facing the electrolyte during electrolysis turned downwardly.

According to British Pat. No. 1,240,012, the sets of suction-cups while still holding the deposits are then conveyed to a deposit storage. According to British Pat. No. 1,387,790, the deposits are detached from the sets of suction-cups, as soon as rest position is reached. The deposits are then placed, with their electrolytic side still turned downwardly, on a horizontal conveyor which conveys the deposits to a further station. Hence, in these known processes there is no or at best minimal viewing of the electolytic side of a deposit from the moment that the deposit is separated from the cathode until it is stocked. In other words, with these known processes it is difficult to inspect the electrolytic side of the deposit. This may not be a drawback when dealing, as in British Pat. No. 1,387,790, with relatively thick deposits, i.e., so-called "commercial size deposits," which constite an electrolytic end product. In such a case, the quality of the electrolytic side is of no importance. However, the fact that it is not possible to make an easy inspection of the electrolytic side of the deposit is a drawback or an undesirable limitation when dealing, as in British Pat. No. 1,240,012, with rather thin deposits, that have to be transformed into starting sheets for metal electrorefining. This limitation is undesirable in that case since it is essential for the electrolytic side of the deposit to be of good quality, i.e. not too nodular, so as to avoid difficulties during a later stage of electrorefining.

An aim or object this invention is to provide a process as described above, which would permit an easy inspection of the electrolytic side of the deposit. Although the process of the present invention is thus particularly desirable for separating deposits that have to be transformed into starting sheets, it is also useful for separating other deposits such as the so-called "commercial size deposits."

DISCLOSURE OF THE INVENTION

The foregoing object is achieved according to the present invention which provides that the sets of suction-cups are pivoted such that the deposits are beneath the sets of suction-cups when the suction-cups reach their rest position. Hence, after they are detached from the sets of suction-cups, the deposits fall downwardly with their electrolytic side facing upwardly. The deposits are permitted to alight on a continuous conveying system whereon they can be individually viewed while passing one after the other with their electrolytic side turned upwardly.

According to a preferred process, the sets of suction-cups are pivoted in two steps by moving away from each other, i.e., in the first step the upper edges of the sets of suction-cups and in the second step their lower edges. Proceeding in this manner, only the upper edges of the sets of suction-cups are moved in the first step. In the second step, first these upper edges are brought nearer to each other before moving them away again.

The rest position is preferably a horizontal or a substantially horizontal position.

In order to at least locally separate the upper edge of the deposits from the cathode, it is advantageous to proceed as described in U.S. Pat. No. 4,045,301. According to this patent, the upper edge is first heated locally until zones are obtained where the deposits part from the cathode. These zones can be further widened by means of knives.

The present invention also relates to a system and an apparatus for separating an electrolytic deposit from both sides of a vertically suspended cathode. The apparatus comprises two sets of suction-cups and means to make these sets of suction-cups pivot from a grip position, i.e., in which the sets of suction-cups are pressed against the cathode, to a rest position in which the sets of suction-cups are positioned away from the cathode.

Typically known apparatuses are described in the aforementioned British Pat. Nos. 1,240,012 and 1,387,790. However, these known apparatuses do not allow the carrying out of the aforementioned process of the present invention.

The apparatus of the present invention which enables the carrying out of the process according to the present invention, is characterized in that the pivoting means comprise for each set of suction-cups a member mounted such that it can pivot on a fixed horizontal axis which is parallel to the cathode, first means for pivoting this member, a jointed coupling disposed between the lower part of the member and the lower edge of the respective set of suction-cups, and second means for pivoting the set of suction-cups on the jointed coupling. In turn, the second pivoting means are connected to the set of suction-cups by a jointed coupling and are mounted such that they can pivot on a fixed horizontal axis which is parallel to the cathode and located at a level lower than the axis.

BRIEF DESCRIPTION OF THE DRAWINGS

Further details and features of the process, system and apparatus of the present invention and its preferred embodiments can be had by reference to the accompanying drawings which illustrate a process, system and apparatus for stripping cathodes of their deposits in a tankhouse for the production of starting sheets for copper electrorefining.

BRIEF DESCRIPTION OF THE DRAWINGS

Figure 1:
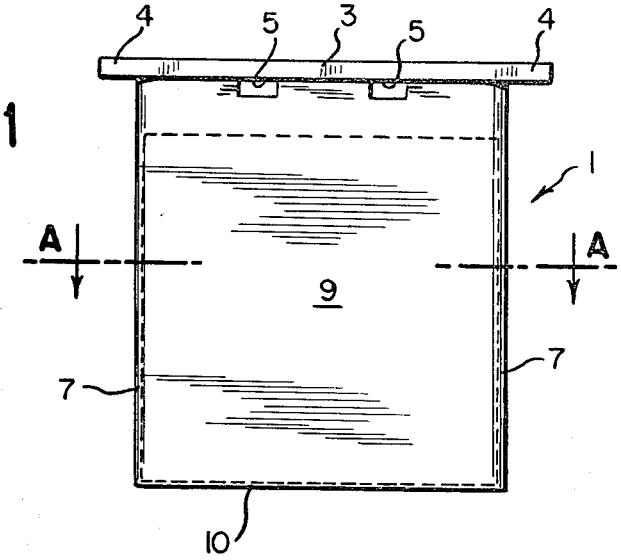
Figure 2:
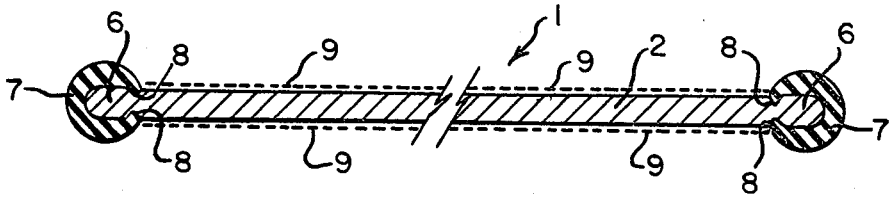
Figure 4:
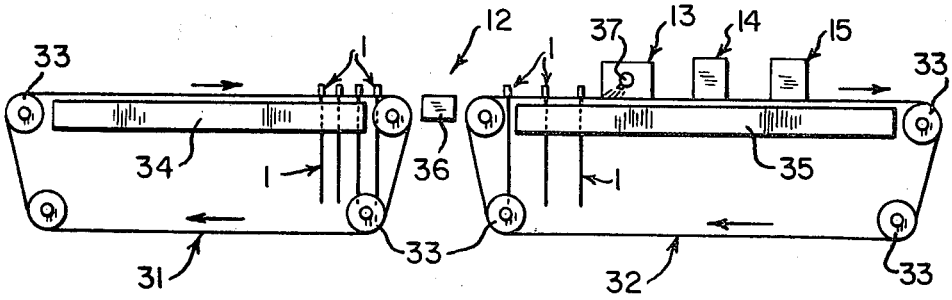
Figure 3:
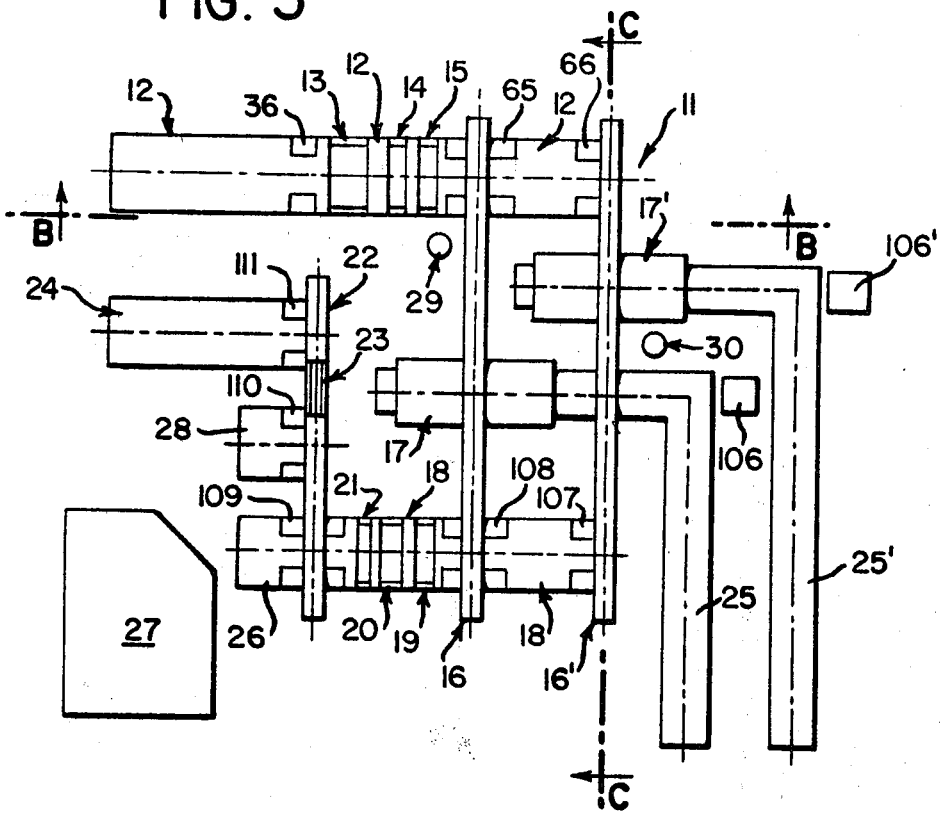
Figure 11:
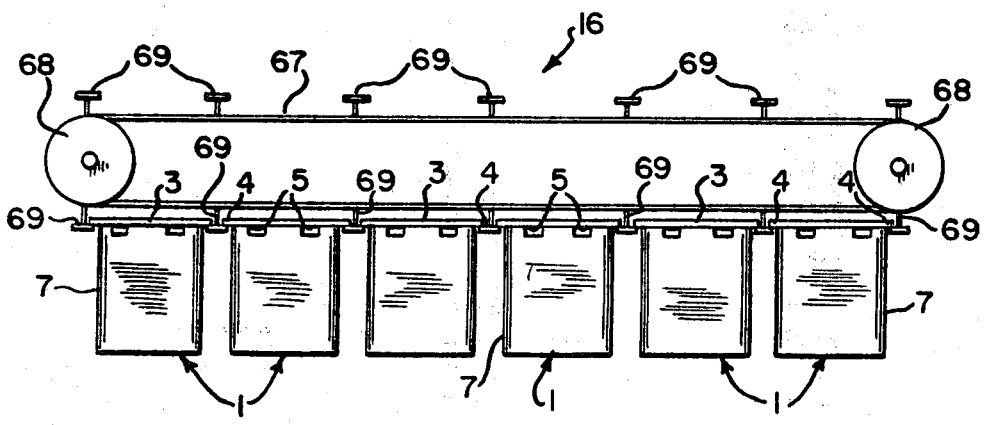
Figure 5:
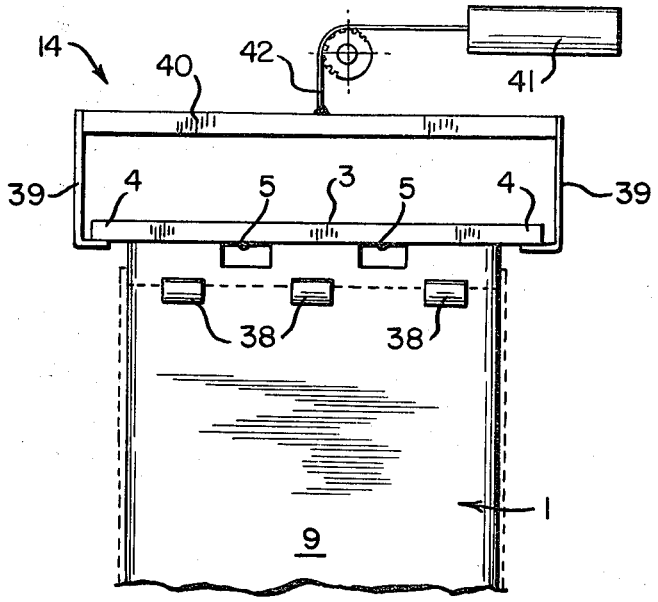
Figure 6:
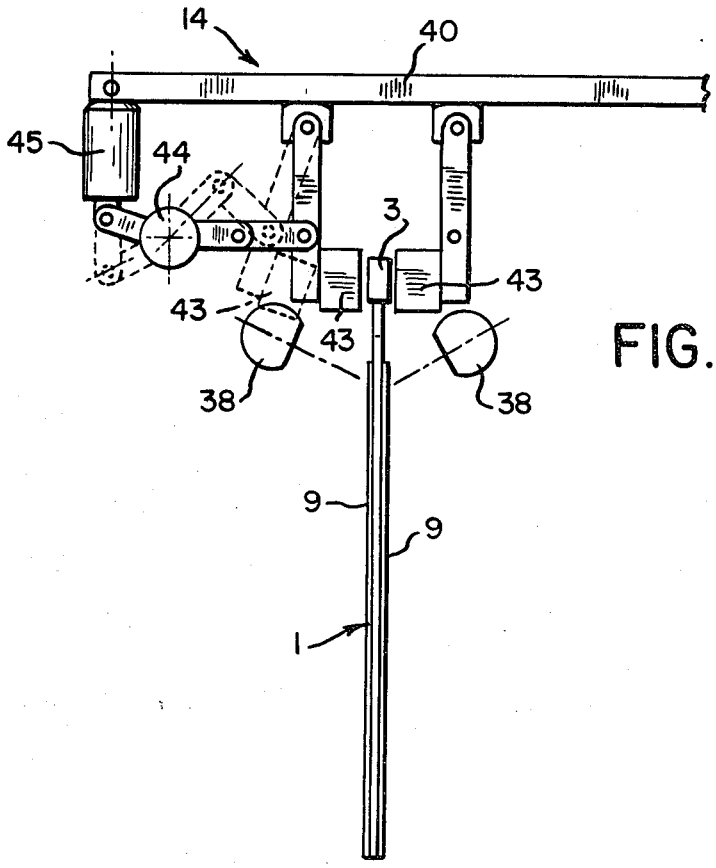
Figure 7:
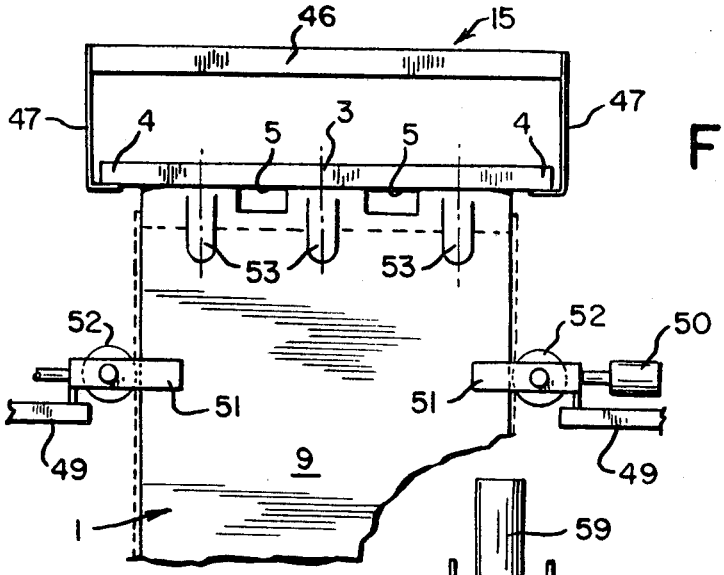
Figure 8:
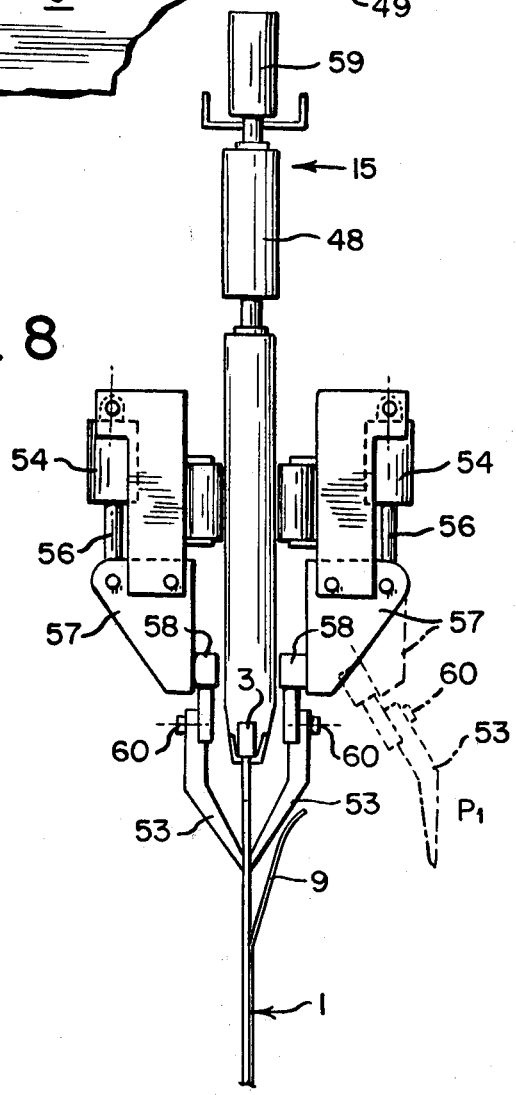
Figure 12:
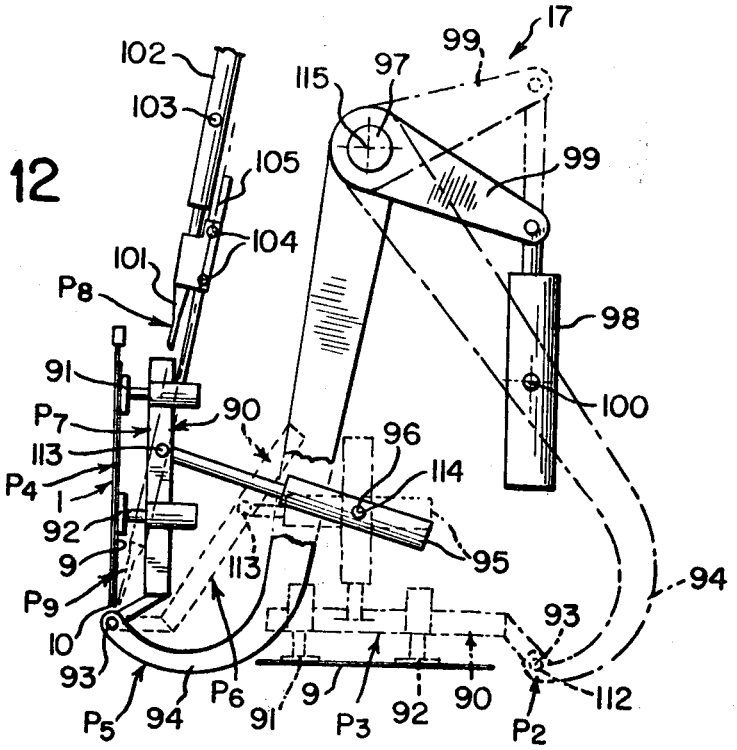
Figure 13:
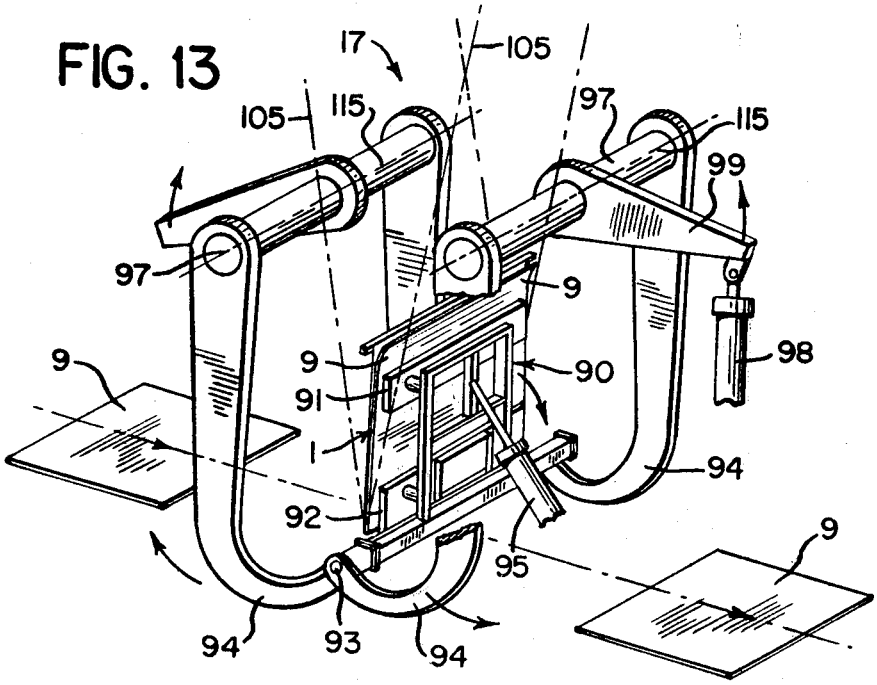

FIG. 1 is a side view of a cathode having an electrolytic deposit thereon;

FIG. 2 is an enlarged view of the cathode along the line A—A of FIG. 1;

FIG. 3 is a plan view of a stripping system according to the present invention;

FIG. 4 is an enlarged view of a portion of the stripping system along the line B—B of FIG. 3;

FIG. 5 is an enlarged front view in greater detail of the thermal pretreating station of the stripping system of FIG. 3;

FIG. 6 is a more detailed side view of the thermal pretreating station of FIG. 5;

FIG. 7 is an enlarged front view of the mechanical pretreating station of the stripping system of FIG. 3;

FIG. 8 is a more detailed side view of the mechanical pretreating station of FIG. 7;

FIG. 9 is yet a further detailed enlarged view of the setting of a knife in the mechanical pretreating station of FIG. 8;

FIG. 10 is still yet a further detailed sectional enlarged view along the line D—D of FIG. 9;

FIG. 11 is an enlarged sectional view of the stripping system along the line C—C of FIG. 3;

FIG. 12 is an enlarged side view of a stripping station of the stripping system of FIG. 3; and FIG. 13 is a perspective view of the stripping station of FIG. 12.

BEST MODE FOR CARRYING OUT THE INVENTION

Referring to the drawings, a cathode 1, as shown in FIGS. 1 and 2, consists of a rolled copper plate 2 provided with a suspension bar 3 having ends 4 which can be used to suspend cathode 1 in an electrolytic cell. Plate 2 has two openings 5 at its upper portion which permit lifting of cathode 1 by means of a pair of hooks or other suitable securement means. The two side edges 6 of plate 2 are each covered with a strap 7 made of an elastic insulating material which is pressed into the grooves 8 of plate 2 as illustrated in FIG. 2. The purpose of this strap 7 is to prevent the formation of a deposit on these side edges 6 during electrolysis. Otherwise, such a deposit would actually weld together the two electrolytic deposits 9 which are formed on the two sides of plate 2. For the same reason, the formation of a deposit on the lower edge 10 of plate 2 must also be prevented. Therefore, the lower edge 10 is coated with an insulating liquid before dipping cathode 1 in the electrolytic cell. When the deposits 9 have reached a sufficient or desired predetermined thickness, the cathode 1 is lifted from the electrolytic cell and conveyed to a stripping system 11, shown in FIG. 3, in order that the two deposits 9 can be stripped off the cathode 1 and so that the cathode 1 can be prepared for reentry into the electrolytic cell.

Referring now to FIG. 3, the stripping system 11 comprises a first longitudinal conveying system 12 which conveys the cathodes to be stripped through a washing station 13, a thermal pretreatment station 14 and a mechanical pretreatment station 15. Two conveying systems 16 and 16' which are transverse to the first longitudinal conveying system 12 carry the pretreated cathodes through the stripping stations 17 and 17'. A second longitudinal conveying system 18 transports the stripped cathodes to a station 19 for cleaning contacts, a station 20 for rectifying the position of the side straps and a first dipping station 21. A conveying system 22 which is transverse to the second longitudinal conveying system 18 transports the stripped cathodes to a second dipping station 23. A third longitudinal conveying system 24 carries off the stripped and prepared cathodes for reuse in an electrolytic cell. Two belt-conveyers 25 and 25' carry off the deposits 9 which are separated from the cathodes in the stripping stations 17 and 17'. An exit 26 at the end of the second longitudinal conveying system 18 permits damaged cathodes to be passed on to a workshop 27 for repair. The repaired cathodes pass through an entry 28 for continued passage along conveying system 22. A control station 29 is provided for the operator of the stripping apparatus and a control station 30 for controlling the quality of the deposits.

The first longitudinal conveying system 12 comprises three pairs of conveyer chains, of which only the first two, 31 and 32, are shown in FIG. 4. The third one, linking transverse conveying systems 16 to 16', is formed in the same manner as the second one 32. The cathodes 1 can be suspended on each pair of chains by their lugs 4. The pairs of chains 31 and 32 rotate around pinions 33 and are provided with a support beam 34 and 35, respectively. A motor (not shown) advances the chains in a step by step fashion. The pair of chains 31 has a pitch of 124 millimeters (mm) while the pair of chains 32, which has a speed twice that of the pair of chains 31, has a pitch of 248 mm. The cathodes 1 to be stripped are arranged in a group, e.g., thirty-two pieces, on the pair of chains 31. The distance between two successive cathodes 1 in any group is 124 mm. The pair of chains 31 moves the cathodes 1 to the pair of chains 32. A transfer device 36 transfers the cathodes 1 from the pair of chains 31 to the pair of chains 32. Since the pitch on the second pair of chains 32 is twice that on the pair of chains 31, the distance between the cathodes increases to 248 mm. This increase of distance is required so that subsequent operations, i.e., washing, thermal pretreatment and mechanical pretreatment, can be implemented under the best possible conditions.

Washing is carried out in station 13. Hot water is sprayed by nozzles 37 which are fitted above and on both sides of the pair of chains 32.

The thermal pretreatment is carried out in station 14, as shown in FIGS. 5 and 6, which is provided with a switch (not shown), e.g., a proximity switch, to detect the presence of a cathode 1 in the thermal pretreatment position. When a cathode 1 is detected, the burners 38 are lighted and cathode 1 is lifted by means of a pair of hooks 39, fixed on the yoke 40. The yoke 40 is driven by cylinder 41 through chain 42. Cylinder 41 is operated by the aforementioned switch. As soon as the rod of cylinder 41 is withdrawn, the suspension bar 3 of cathode 1 is clamped between the jaws 43, which are brought in clamping position by a system of rods 44 operated by cylinder 45. The purpose of this clamping is to hold cathode 1 in a central position between the burners 38 and to avoid curving of the suspension bar during heating. The upper edges of the deposits 9 are now within reach of the burners 38. After the predetermined heating time, e.g., three seconds, the burners extinguish, the jaws 43 open, the yoke 40 comes down and the cathode 1 is once again positioned on the pair of chains 32. The local heating makes the deposit 9 expand and detach from the cathode 1 in the burners zone.

The cathode 1 is further conveyed to the thermal pretreatment station 15, as shown in FIGS. 7 and 8, where its arrival is also detected. At its detection, the cathode 1 is lifted by the yoke 46 with the hooks 47. The yoke 46 is driven by cylinder 48. Simultaneously with cylinder 48, the centering devices 49 are operated on both sides of cathode 1. Each centering device 49 comprises a cylinder 50, a guiding-fork 51 and diabolo-roller 52, which maintains the cathode 1 in a central position between the knives 53, when pressed against the side edge of cathode 1 by cylinder 50. When the rod of cylinder 48 is withdrawn, the knives 53 leave their rest position P1 and are pressed against cathode 1 by cylinder 54, the rod 56 of which is connected with the pivoting member 57 on which the knife-holder 58 is fitted. Upon the detection of the arrival of the knives 53 against the cathode 1, the rod of cylinder 59 is withdrawn, lifting the cathode further by 100 mm and introducing the knives 53 into the gaps formed during the thermal pretreatment between the deposits 9 and cathode 1. When the rod of cylinder 59 is completely withdrawn, the rod of cylinder 54 is also withdrawn. Thus, the knives 53 are removed from cathode 1 to their rest position P1, widening in this manner the gaps between the deposits 9 and the cathode 1.

The cylinders 48 and 59 then cause the yoke 46 to come down again, while the cylinder 50 causes the centering device 49 to open. The cathode 1 is in this fashion again positioned on the pair of chains 32.

As shown in FIGS. 9 and 10, the knife 53 is fastened to the lower part of its knife-holder 58 by means of bolts 60 and thus can be easily replaced. The upper part 64 of the knife-holder 58 has a cylindrical shape and can rotate in two ball-bearings 62 fitted on the pivoting member 57. The rotation of the knife-holder 58 and the knife 53 fastened to it is restricted by the stops 63 provided under the pivoting member 57 and acting on the upper part of knife 53. The knives 53 can thus pivot around their axis with, however, a restricted rotation-angle which presents the advantage that the knives 53 are self-adjusting. This means that the flats 61 of the knives 53 are automatically placed in a perfect parallel relationship against the face of cathode 1 when the rod of cylinder 54 is pushed out. This parallelism is important so that the knives 53 do not damage the cathode 1 during their operation.

After being positioned again on the pair of chains 32 by the yoke 46, the cathode 1 is further conveyed to the two way transfer device 65. There the cathode 1 is transferred either to the transversal conveying system 16 leading to the stripping station 17 or to the third pair of chains of the first longitudinal conveying system 12 leading over the transfer system 66. The latter transfers the cathode 1 to the transverse conveying system 16' leading to the stripping station 17'. The cathodes 1 reaching the two-way transfer device 65 are transferred alternately to the transversal conveying system 16 and to the third pair of chains of the longitudinal conveying system 12 so that the stripping stations 17 and 17', which are identical, can treat the same number of cathodes 1.

As shown in FIG. 11, the transverse conveying system 16 comprises a chain 67 which rotates around pinions 68 and is equipped with T-hooks 69 to suspend the cathodes 1. A motor (not shown) drives the belt 67 with a pitch of 1,350 mm. The transverse conveying system 16' is identical to the transverse conveying system 16.

The construction and the operation of the stripping apparatus as the stripping station 17 are illustrated in FIGS. 12 and 13. The stripping station 17 comprises two sets of suction-cups 90, each one equipped with four suction-cups. Each set 90 includes a large suction-cup 91 on the top and three small suction-cups 92 underneath which are assembled on a frame. Each set 90 is laterally connected at its lower part by means of a jointed coupling 112 at the ends 93 of two arms 94. The rotation of set 90 around this coupling 112, i.e., with regard to the arms 94, is operated by cylinder 95 whose rod is connected to set 90 by means of a jointed coupling 113. Cylinder 95 itself is mounted in such a way that it can pivot on the fixed hinge 96, i.e, around horizontal axis 114. The arms 94 are fastened on a shaft 97 that pivots in fixed bearings (not shown) around horizontal axis 115. The rotation of the shaft 97 and the arms 94 fastened to it is operated by cylinder 98 through the linking arm 99. Cylinder 98 pivots on the fixed hinge 100.

When the stripping station 17 is in the rest position, the rod of cylinder 95 is withdrawn and that of cylinder 98 is out; the ends 93 of the arms 94 are then in position P2 and the set of suction-cups in position P3. When cathode 1 is detected in position P4 by a detecting device (not shown), the rod of cylinder 98 is withdrawn which causes the ends 93 of the arms 94 to move from the position P2 to the position P5. In addition, the set of suction-cups 90 move from the position P3 to the position P6. When the arms 94 are detected in position P5 by a detecting device (not shown), the rod of cylinder 95 is pushed out and the set of suction-cups 90 goes from position P6 to position P7, in which the suction-cups 91 and 92 are pressed against deposit 9. The four suction-cups 91 and 92 are independent, i.e., each of them is connected to its own vacuum source. When the position P7 is reached, the suction-cups are placed under vacuum. The vacuum in the suction-cups is measured by means of suitable detecting devices (not shown). As soon as a predetermined level of pressure, e.g.,-0.7 bar, is reached, the rod of cylinder 95 is withdrawn and the set of suction-cups 90 with the deposit 9 attached on it returns from position P7 to position P6. When the above-mentioned vacuum measuring devices detect a loss of vacuum, the above described operation is automatically repeated.

When, after reaching the predetermined vacuum level, the rod of cylinder 95 is withdrawn and the arrival of set 90 in position P6 is detected by a suitable detecting device (not shown), the knife 101 comes down. The knife 101 is driven by cylinder 102 which pivots on a fixed hinge 103. The knife 101 is provided on both sides of the cathode 1 with guiding rollers 104 for which there are fixed guides 105.

The knife 101 would be unnecessary if there were no formation of copper deposit at the lower edge 10 of cathode 1 during the electrolysis. In that case indeed, a transition of the set of suction-cups 90 from position P7 to position P6 would be sufficient to completely detach the deposit 9 from the cathode 1. However, if metal deposits do occur on the lower edge 10 so that both deposits 9 are actually welded together at their lower edges, which often occurs in practice notwithstanding the coating of the lower edge 10 with the above-noted insulating liquid, the aforementioned transition is not sufficient to separate the deposits 9 from each other and from the lower edge of cathode 1. In that case, it is useful to employ knife 101. Thus, pending the use of a fool-proof means to totally avoid the formation of a deposit at the lower edge 10, the stripping station 17 will be equipped with knife 101.

The upper position P8 and the lower position P9 of the knife 101 are detectable by suitable detecting means (not shown). If the knife 101 does not reach its lower position P9, which corresponds to the end of the stroke of cylinder 102, possibly due to the fact that the deposit 9 did not separate from the lower edge of cathode 1 and/or from the opposite deposit 9 under the effect of the first operative action of the knife 101, the operation of the knife 101 is repeated. The upper position P8 is detected in order to check if the rod of cylinder 102 is completely withdrawn. Otherwise, the subsequent movement of the set of suction-cups 90 might be hampered by the knife 101.

When the knife 101 is detected in position P9, the rod of cylinder 98 is pushed out and the set of suction-cups 90 with the deposit 9 attached thereto moves from the position P6 to the position P3 as shown in FIG. 12. The vacuum is now released and air is blown into the suction-cups 91 and 92. The deposit 9 is thereby detached from the set 90 and falls with its electrolytic side turned or facing upwardly, on the conveyer belt 25, shown in FIG. 3, which conveys the deposit 9 to a storage device (not shown). An inspector at the control station 30 can check the quality of the deposits 9 and direct bad quality deposits by means of a remote control to the baskets 106 and 106'.

The stripped cathodes are conveyed from the stripping stations 17 and 17' by means of the transverse conveying systems 16 and 16' to the second longitudinal conveying system 18 which comprises two pairs of chains similar to those of the first longitudinal conveying system 12. The transition from transverse conveying system 16' to the conveying system 18 is achieved by transfer device 107. The transition from the conveying system 16 to the conveying system 18 is achieved by a two-way transfer device 108 which also operates the transition from the first to the second pair of chains of the second longitudinal conveying system 18 across the transverse conveying system 16.

The second longitudinal conveying system 18 transports the stripped cathodes 1 first to the station 19 for cleaning the contacts of the stripped cathodes 1. There, after lifting the cathode 1, the lower surface of the lugs 4 of the cathodes 1 is cleaned by means of rotating metallic brushes. This cleaning is important since cathode 1 is placed under current during the electrolysis through the aforesaid lower surface. In the same station 19, the copper deposit, that might have been formed during the electrolysis on the lower edge 10 of the cathode 1 can be removed by means of scrapers. If desired, it is not necessary to use station 19 during each stripping operation or cycle. Its use depends on the state of the lugs 4 and the lower edges 10. It is possible, for example, to use station 19 to clean the lugs 4 in one operation or cycle and to clean the lower edges 10 in another.

Cathode 1 next reaches station 20. There, the cathode 1 is clamped and rolls, actuated by an upwards and downwards movement, are pressed against the side straps 7 so as to correct, if necessary, the position of these straps. As was the case with station 19, use of station 20 during each stripping operation or cycle is optional.

The cathode 1 next moves on to the first dipping station 21. There the cathode is clamped and a pillow, impregnated with an insulating liquid, is pressed against the lower edge 10 of the cathode. The insulating liquid helps to avoid, as already noted before, the formation of a deposit on this lower edge during the electrolysis.

The cathode 1 then arrives at the two-way transfer device 109. If an operator in station 29 determines that the quality of the cathodes 1 is undesirable, then the two-way transfer device 109 is operated so as to pass the cathodes onto the pair of exit chains 26 while those of satisfactory quality are passed onto the transverse conveying system 22 which is similar to the transverse conveyors 16 and 16'. The gaps created in the transverse conveying system 22 by the ejection of the defective cathodes at device 109 are immediately filled up with repaired cathodes from the workshop 27 through the entry 28 and the transfer device 110.

Transverse conveyor 22 conveys the cathodes to a second dipping station 23 where the cathodes are coated with a layer of an anti-adhesive agent so that during subsequent electrolysis the deposit 9 does not adhere too strongly to the cathode 1. Such strong adhesion, of course, would cause difficulties during stripping later on.

The stripped cathodes are now ready once again to receive an electrolytic deposit. Accordingly, they pass through the transfer device 111 to the third longitudinal conveyer 24, from where they will be lifted to be conveyed to the electrolytic cells.

It is contemplated that numerous modifications can be effected to the above described process, system and apparatus without, however, departing from the scope of present invention.

In this regard, it is possible, e.g., to operate with only one stripping station instead of two. Although, this might lower the productivity of the installation, however, it would be sufficient for electrolytic plants having a small capacity.

Having thus described our invention, what we claim as new and desire to secure by Letters Patent is:

1. A process for separating electrolytic deposits from both sides of a generally vertically suspended cathode, comprising detaching at least a portion of the upper edge of each deposit from its respective side of the cathode, attaching a set of suction cups to each deposit, moving said sets of suction cups in a first step to an intermediate position, in which the deposits attached to the sets of suction-cups are in a form of a substantially V-shaped-configuration so that deposits are separated off the cathode downwardly, and bringing in a second step the sets of suction-cups from said intermediate position to a rest position in which the sets of suction-cups are oriented so that the deposits attached thereto are positioned beneath them.

2. The process according to claim 1 further characterized by separating, between said first and said second steps, the lower edges of the deposits from each other.

3. The process according to claim 2 characterized in that the separation of the lower edges of the deposits is accomplished by means of knives.

4. The process according to claim 1 characterized in that detaching at least a portion of the upper edge of each deposit includes locally preheating said portions until zones of separation are obtained wherein the deposit separates from the cathode.

5. The process according to claim 4 further characterized in that said zones of separation are widened by means of knives.

6. The process according to claim 5 characterized in that the cathode is clamped during said local preheating.

7. The process according to claim 6 characterized in that said knives are capable of pivoting about their axes with a restricted rotation angle.

8. The process according to claim 1 characterized by transforming the deposit after removal from the cathode into a starting sheet for the electrorefining of metal, preferably copper.

9. An apparatus for separating an electrolytic deposit from both sides of a vertically suspended cathode, comprising two sets of suction-cups and means for moving these sets of suction-cups in opposite directions from a grip position, in which the sets of suction-cups are pressed against the cathode, to a rest position, in which the sets of suction-cups are away from the cathode, characterized in that said moving means are adapted to move the sets of suction-cups around a common axis extending substantially along the lower edge of the cathode, from the grip position to an intermediate position in which the deposits attached to the sets of suction cups are in a form of a substantially V shaped-configuration so that the deposits are separated off the cathode downardly, and to bring then the sets of suction-cups from said intermediate position to the rest position, in which the sets of suction-cups are oriented so that the deposits attached thereto are positioned beneath them.

10. An apparatus for separating electrolytic deposits from both sides of a generally vertically positioned cathode, comprising suction means capable of being attached to the deposit, means for moving said suction means from a first position wherein said suction means is pressed against the cathode to a second position wherein said suction means is positioned away from the cathode, said moving means including a member pivotally mounted about a first fixed generally horizontal axis being generally parallel to the cathode, first coupling means connecting said member and the lower edge of said suction means, second coupling means connected to said suction means, first means for pivoting said member about said first fixed generally horizontal axis, second means connected to said second coupling means for pivoting said suction means about said first coupling means, said second pivoting means being pivotally mounted about a second fixed generally horizontal axis being generally parallel to the cathode and being positioned lower than said first fixed generally horizontal axis, said first and second pivoting means being selectively operable such that said deposits can be separated from the respective sides of the cathode downwardly and thereafter positioned so as to permit inspection of the electrolytic side of the deposit.

11. The apparatus according to claim 10 characterized in that said suction means comprises a set of suction cups associated with each side of the cathode.

12. The apparatus according to claim 11 characterized in that said first and said second coupling means are each of a jointed configuration.

13. The apparatus according to claim 12 further characterized by at least one knife positioned on each side of said cathode and capable of being driven so as to separate the lower edges of the deposits apart from each other when the deposits have been removed from the surfaces of the cathode.

14. A system for removing electrolytic deposits from a cathode characterized by a thermal pretreatment station configured so as to locally heat the upper edges of the deposits until zones of separation of the deposit from the cathode are obtained, a mechanical pretreatment station configured so as to be capable of widening the zones of separation formed at the thermal pretreatment station, and a stripping station for removal of the electrolytic deposit from the cathode, said stripping station including suction means capable of being attached to the deposit, means for moving said suction means from a first position wherein said suction means is pressed against the cathode to a second position wherein said suction means is positioned away from the cathode, said moving means including a member pivotally mounted about a first fixed generally horizontal axis being generally parallel to the cathode, first coupling means connecting said member and the lower edge of said suction means, second coupling means connected to said suction means, first means for pivoting said member about said first fixed generally horizontal axis, second means connected to said second coupling means for pivoting said suction means about said first coupling means, said second pivoting means being pivotally mounted about a second fixed generaly horizontal axis being generally parallel to the cathode and being positioned lower than said first fixed generally horizontal axis, said first and said second pivoting means being selectively operable such that said deposits can be separated from the respective sides of the cathode downwardly and thereafter positioned so as to permit inspection of the electrolytic side of the deposit.

15. The system according to claim 14 characterized in that said suction means comprises a set of suction cups associated with each side of the cathode.

16. The system according to claim 15 characterized in that said first and said second coupling means are each of a jointed configuration.

17. The system according to claim 14 characterized in that said thermal pretreatment station includes a plurality of burners positioned adjacent the upper edges of the deposits.

18. The system according to claim 17 characterized in that the thermal pretreatment station further includes means to clamp the cathode in a generally rigid configuration prior to the heating of the upper edges of the deposits.

19. The system according to claim 14 characterized in that the mechanical pretreatment station includes a plurality of moveable knives capable of pivoting about their axes with a restricted rotation angle.

* * * * *